US007998033B1

(12) United States Patent
Schroeder

(10) Patent No.: US 7,998,033 B1
(45) Date of Patent: Aug. 16, 2011

(54) LOCKING MECHANISM FOR A BICYCLE TRAINER

(75) Inventor: Duane G. Schroeder, New Hope, MN (US)

(73) Assignee: Kurt Manufacturing, Inc., Minneapolis, MN (US)

( * ) Notice: Subject to any disclaimer, the term of this patent is extended or adjusted under 35 U.S.C. 154(b) by 0 days.

(21) Appl. No.: 12/613,147

(22) Filed: Nov. 5, 2009

Related U.S. Application Data

(60) Provisional application No. 61/111,461, filed on Nov. 5, 2008.

(51) Int. Cl.
*A63B 69/16* (2006.01)

(52) U.S. Cl. ..... 482/61; 434/61

(58) Field of Classification Search ..... 482/61, 482/51, 57, 148, 908; 434/61
See application file for complete search history.

(56) References Cited

U.S. PATENT DOCUMENTS

| | | | | |
|---|---|---|---|---|
| 4,969,642 | A * | 11/1990 | Phillips | 482/61 |
| 6,019,708 | A * | 2/2000 | Kaminski et al. | 482/57 |
| 6,203,472 | B1 * | 3/2001 | McCaffrey et al. | 482/61 |
| 6,659,917 | B1 * | 12/2003 | Tacx | 482/63 |
| 7,407,466 | B2 * | 8/2008 | Chiu | 482/61 |
| 7,727,124 | B1 * | 6/2010 | Lassanske et al. | 482/61 |
| 7,758,474 | B1 * | 7/2010 | Pedrini | 482/61 |
| 2004/0053751 | A1 * | 3/2004 | Pizolato | 482/61 |

* cited by examiner

*Primary Examiner* — Steve R Crow
(74) *Attorney, Agent, or Firm* — Steven M. Koehler; Westman, Champlin & Kelly, P.A.

(57) ABSTRACT

A bicycle trainer frame adapted for use with a bicycle includes a frame member having spaced apart ends. A coupler is disposed in at least one of the ends, the coupler having engaging cam elements to cause linear movement of a rod. A lever is connected to one of the cam elements wherein the cam surfaces are configured to cause linear movement for rotation of lever less than one revolution such that the rod moves from a first position to a second position, the first position being spaced apart from a component of the bicycle to allow removal of the bicycle from the frame, and the second position being sufficient to secure the bicycle to the frame.

21 Claims, 9 Drawing Sheets

LOCKING MECHANISM FOR A BICYCLE TRAINER

CROSS-REFERENCE TO RELATED APPLICATION

This application claims the benefit of U.S. Provisional Application entitled "LOCKING MECHANISM FOR A BICYCLE TRAINER" having Ser. No. 61/111,461 filed Nov. 5, 2008, the content of which is also incorporated herein by reference in its entirety.

BACKGROUND

The discussion below is merely provided for general background information and is not intended to be used as an aid in determining the scope of the claimed subject matter.

Bicycle trainers have been used by bicycle enthusiasts to convert their bicycles for stationary riding. A typical user is a bicycle owner who competes in various bicycle races or rides often. When the weather prevents riding outdoors, such as when it is raining, too cold or too hot, the cyclist can use the trainer indoors to simulate a ride. In some cases, the cyclist may want to use a trainer while also reading or watching television. However, in all cases, the bicycle trainer should be easy to use and simulate bicycle riding.

A common bicycle trainer has a frame onto which the user mounts the bicycle. Typically, the rear wheel of the bicycle is in contact with a roller that, in turn, is coupled to a resistance unit. The roller is supported by the frame at a fixed distance from couplers that engage and support the bicycle in an upright position. In one particular embodiment, the couplers include threaded shafts, which are individually rotated to a desired position to engage the bicycle. This design, however, can be cumbersome when securing the bicycle to the frame. In other embodiments, one of the couplers comprises a threaded shaft that is adjusted and then generally left alone, while the other coupler includes a locking mechanism that is operated to lock the bicycle in position. The locking mechanism however may not be easy to manipulate for all users.

SUMMARY

This Summary and the Abstract herein are provided to introduce a selection of concepts in a simplified form that are further described below in the Detailed Description. This Summary and the Abstract are not intended to identify key features or essential features of the claimed subject matter, nor are they intended to be used as an aid in determining the scope of the claimed subject matter. The claimed subject matter is not limited to implementations that solve any or all disadvantages noted in the background.

A first aspect of the invention is a bicycle trainer frame having a frame member with spaced apart ends. A coupler is disposed in each end and has a movable element. A lever is connected to each coupler to operate each of the couplers so as to move the elements toward each other in a first directional movement of the lever and away from each other in a second directional movement of the lever.

In an embodiment, each element comprises a rod that is configured for at least linear movement, which can also be configured to at least partially rotate.

Each coupler can comprise engaging cam elements configured to cause movement of each respective rod, wherein the lever is connected to one of the cam elements of each coupler. For example, the lever can be connected to each of the rods.

In another aspect, a bicycle trainer frame includes a frame member having spaced apart ends, a lever and a coupler disposed in at least one of the ends. The coupler includes a rod that is axially displaceable with at least partial rotation thereof, the rod including at least one spiral surface forming a first cam surface engaged by an axially stationary complementary member that includes a second cam surface engaging the first cam surface. The lever is connected to the rod to selectively rotate the rod, the at least one spiral surface being configured to displace the rod at least one-quarter of an inch for pivotal movement of the lever less than 180 degrees about an axis of the rod.

In yet another aspect, a bicycle trainer frame includes a frame member having spaced apart ends. A coupler is disposed in at least one of the ends. The coupler includes engaging cam elements having cam surfaces to cause linear movement of a rod. A lever is connected to one of the cam elements. The cam surfaces are configured to cause at least one-quarter of an inch of linear movement for rotation of lever less than one revolution such that the rod moves from a first position to a second position, the first position being spaced apart from a component of the bicycle to allow removal of the bicycle from the frame, and the second position being sufficient to secure the bicycle to the frame.

In yet another aspect, a bicycle trainer frame includes a frame member having spaced apart ends. A coupler is disposed in at least one of the ends, the coupler having cam elements with engaging cam surfaces to cause linear movement of a rod. A lever is connected to one of the cam elements wherein the lever is longer than a radius of a bicycle wheel mounted to the frame. The cam surfaces are configured to cause linear movement for rotation of lever less than one revolution such that the rod moves from a first position to a second position, the first position being spaced apart from a component of the bicycle to allow removal of the bicycle from the frame, and the second position being sufficient to secure the bicycle to the frame.

In yet further embodiments of the aspects and embodiments mentioned above, the cam elements of each coupler can comprise at least one spiral cam surface and a member engaging the said at least one spiral cam surface. The spiral cam surface can be formed as a projection or as a groove and the member can take the form of a ball. The ball can be held in a stationary axial position by an element of the coupler such as a housing or a bushing, the rod extending through a bore in the housing or bushing. A mechanism can be provided and configured to selectively provide a frictional force to inhibit rotation and thus axial movement of the rod. In one embodiment, the mechanism can operate upon the ball.

DETAILED DESCRIPTION OF THE ILLUSTRATIVE EMBODIMENTS

Figure 1:
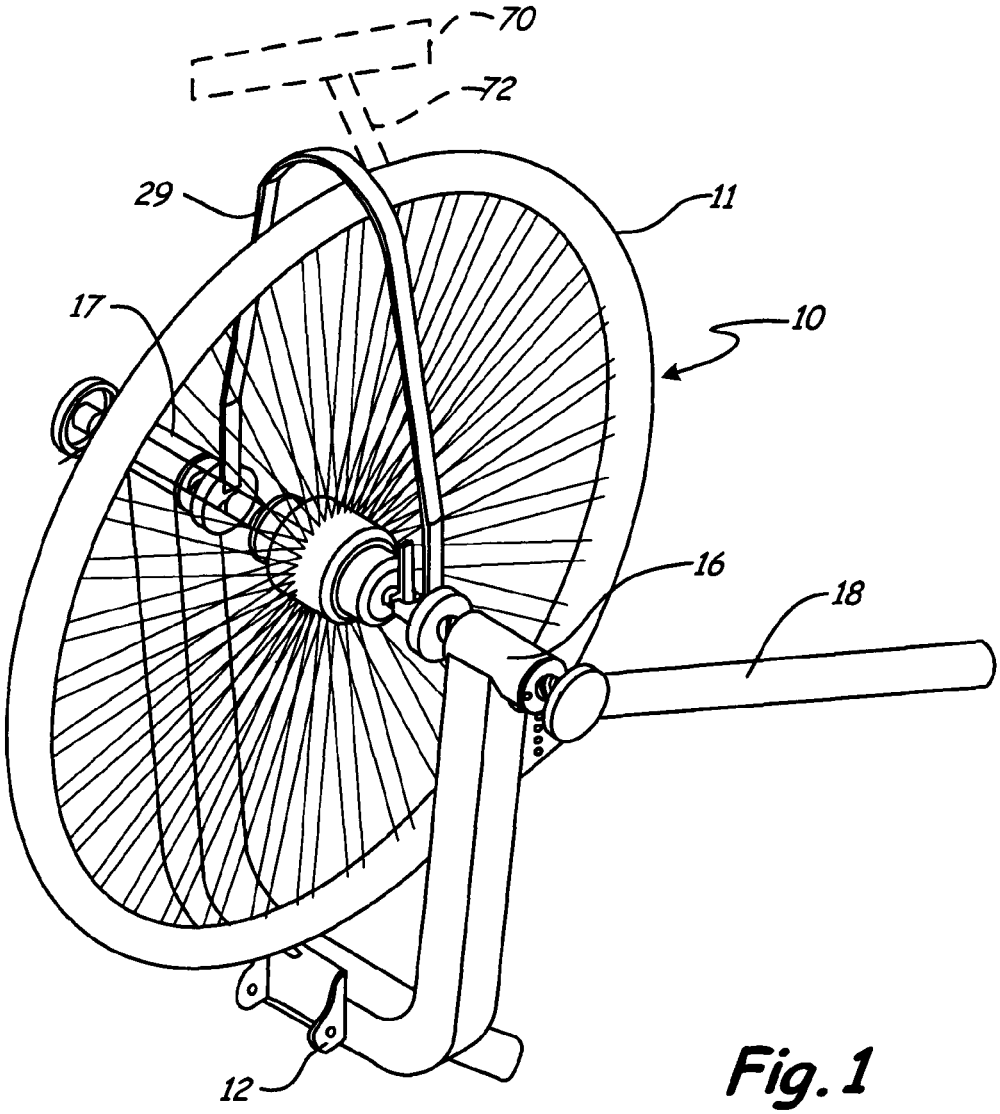
FIG. 1 is a perspective view of a bicycle trainer frame with a leg removed and having lever actuated couplers.
Figure 2:
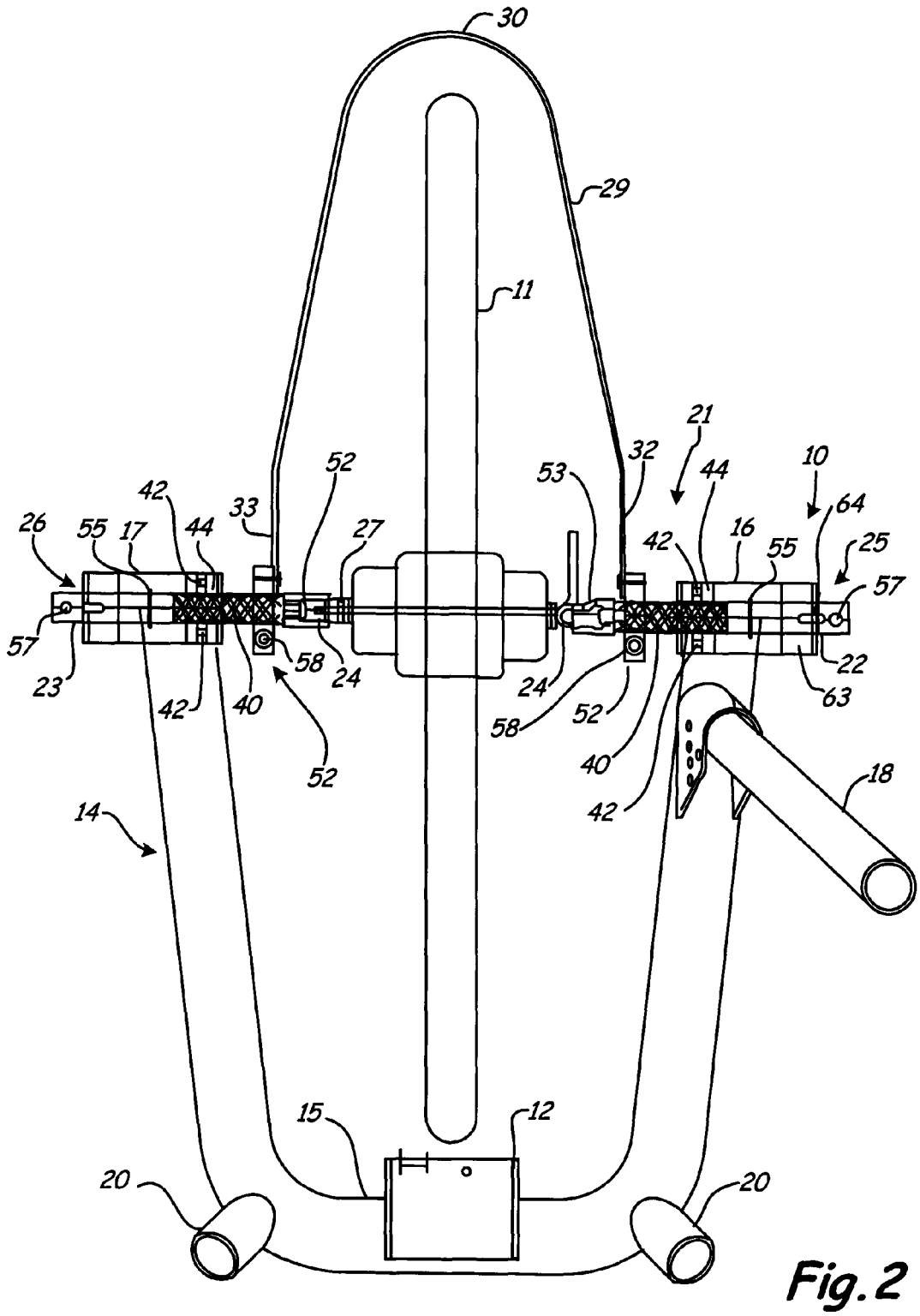
FIG. 2 is a schematic view of a second embodiment of a bicycle trainer frame having lever actuated couplers.

An exemplary embodiment of an exerciser or trainer 10 with a mounting bracket 12 for a movable resistance device is illustrated in FIGS. 1 and 2. As well known to those skilled in the art, trainer 10 is a bicycle trainer that is adapted to support a tire and wheel of a bicycle or other pedaled device (hereinafter "bicycle" by way of example, and where wheel 11 is used as a representation of all types of pedaled devices). The resistance device, which various types are well known, can be mounted to bracket 12 and includes a roller that engages a tire of the bicycle. The resistance device can include a rotatable resistance assembly such as an impeller rotatable in a fluid such as oil such as shown and described in U.S. Pat. No. 6,702,721 incorporated by reference in it's entirety. However, it should be understood that the trainer 10 can be used with many forms of resistance devices wherein the specific implementation mentioned herein should not be limiting.

An exemplary frame 14 is illustrated and supports the rotating wheel of a bicycle. In this embodiment, the frame 14 is generally referred to as a hyperboloid, for example, "U" or "V" shaped having a center portion 15, wherein support ends 16 and 17 are remote from center portion 15 and spaced apart from each other. Legs 18 (one of which is shown, but where a similar leg is proximate end 17) are secured proximate the ends 16 and 17 and extend downwardly. In one embodiment, the legs 18 are pivotally secured so as to allow the frame 14 to assume a compact position for storage and/or shipping. In this embodiment, the frame 14 further includes support feet 20 joined to the center portion 15 that provides additional stability. However, it should be understood, the frame 14 herein illustrated is but one example and should not be considered limiting because the support mechanism described below can be adapted to many types of frames.

A support mechanism or assembly 21, comprising support couplers 25 and 26, releasably supports the bicycle above a floor and to the frame 14. In particular, the couplers 25 and 26 engage opposed portions of the bicycle. Commonly, each of the couplers 25 and 26 engage a nut 24 on each end of an axle 27 of the wheel 11 of the bicycle; however, if desired other portions of the bicycle could be engaged.

The couplers 25 and 26 are located in the opposed support ends 16 and 17, respectively and include rods 22 and 23, respectively, that are movable in apertures in the frame 14 (herein ends 16 and 17). However, unlike bicycle trainers commonly known in the art, and as one aspect of the present invention, the support mechanism 21 includes an actuating lever 29 to actuate both of the couplers 25 and 26 so that, for a first motion of the lever 29, rods 22 and 23 move simultaneously toward each other to engage the bicycle and retain it on the trainer 10, and likewise, move simultaneously away from each other for a second motion of the lever 29 to release the bicycle and allow it to be removed from the trainer 10. In the embodiment illustrated, the lever 29 is U-shaped having a center portion 30 with opposed ends 32 and 33, wherein end 32 is operatively joined to coupler 25 and end 33 is operatively joined to coupler 26.

Generally, each coupler 25 and 26 includes opposed engaging surfaces of elements wherein when one of the elements is moved relative to the other (due to movement of the lever 29), and it causes the corresponding rod 22 or 23 of each coupler to move axially or linearly in the support ends 16 or 17. The opposed engaging surfaces thus can be considered cam surfaces. In the embodiment illustrated, a first cam surface of each coupler 25 and 26 is rotatable being connected to lever 29, while a second cam surface remains essentially stationary, relative to motion of the first cam surface, so that at least linear or axial movement of the rods 22 and 23 occurs, wherein the linear or axial movement may be accompanied with rotational movement of the rods 22 and 23 in an embodiment described below.

In the embodiment illustrated, lever 29 is fixedly joined to each of the rods 22 and 23 so as to cause at least partial rotation of the rods 22 and 23 about their longitudinal axes. A first cam surface is provided on or connected to each rod 22 and 23 to rotate therewith, while a second cam surface that is stationary (relative to axial movement of the corresponding rod) is present in each of the ends 16 and 17 formed thereon or connected thereto. In one embodiment, one of the cam surfaces is in the form of a spiral.

In the exemplary embodiments herein provided, the first cam surface on each rod 22 and 23 comprise the walls of at least one, and in further embodiments, a plurality of spiral surfaces 40 (e.g. two or three) herein by example, grooves. The second cam surface is formed on a complementary member such as a projection 42 (or a plurality of projections 42, if more than one is desired, or if a plurality of spiral surfaces 40 are provided on each rod 22 and 23). However, it should be noted that the spiral surface(s) 40 on one of the rods is of opposite orientation to that of the other in that one is of right-hand orientation, while the spiral surface(s) 40 of the other rod is of left-hand orientation.

In this embodiment, the complementary member(s) 42 are stationary relative to axial movement of the rods 22 and 23. In operation, when the rods 22 and 23 are partially rotated by lever 29, the rods 22 and 23 will also move axially so that the complementary member(s) 42 remain engaged with their corresponding surface(s) 40. The opposed left-hand and right-hand orientation of the surfaces(s) 40 on the rods 22 and 23 cause the rods 22 and 23 to move toward each other for one motion of the lever 29, and away from each other for an opposite motion of the lever 29. In the embodiment illustrated, the complementary member(s) 42 are present in bushings 44 that support each of the rods 22 and 23 for guided movement. However as appreciated by those skilled in the art, the location of the spiral surface(s) and complementary member(s) can be reversed. In other words, in an alternative embodiment, the surface(s) can be formed in each of the bushings 44, while the rods 22 and 23 each include complementary members(s) to engage the surfaces(s).

Figure 3:
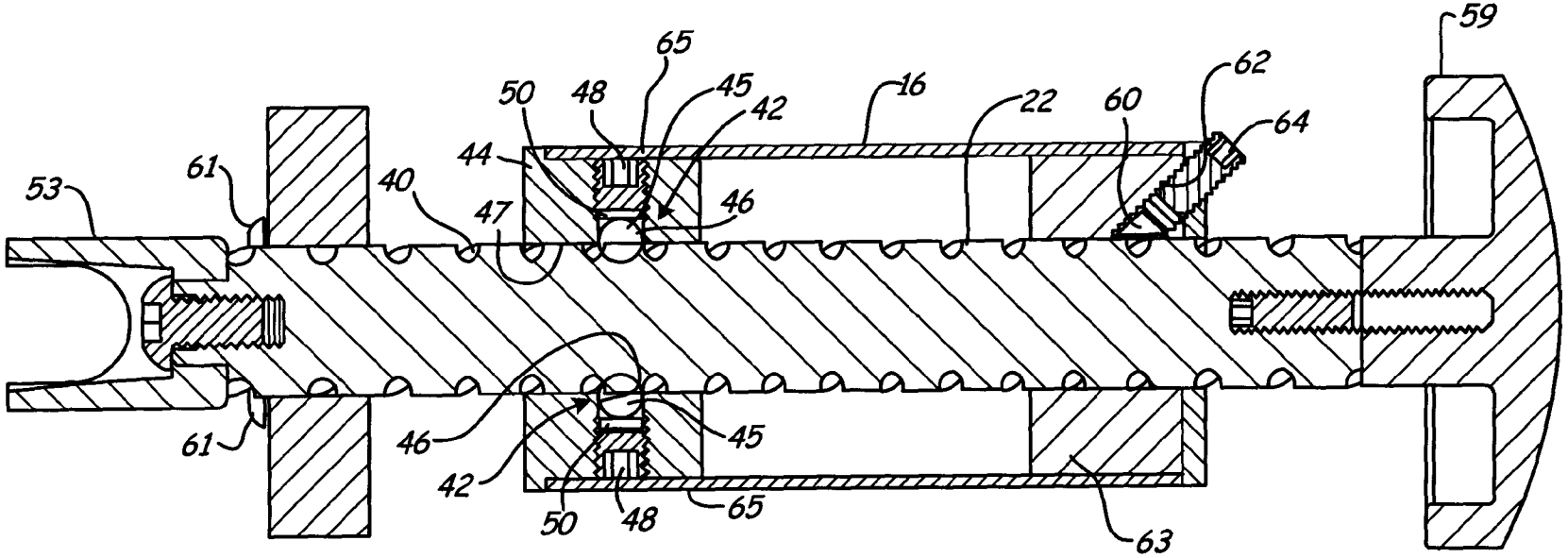
FIG. 3 is a sectional view of an embodiment of a coupler.
Figure 4A:
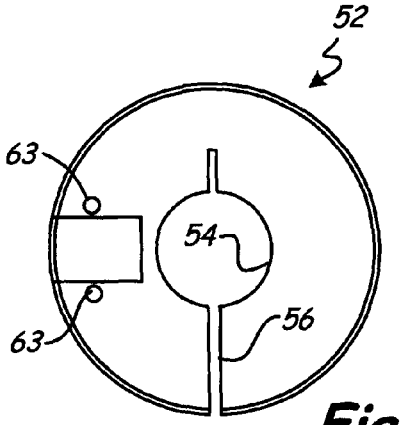
FIGS. 4A-4D are views of a clamp for an end of the lever.
Figure 4B:
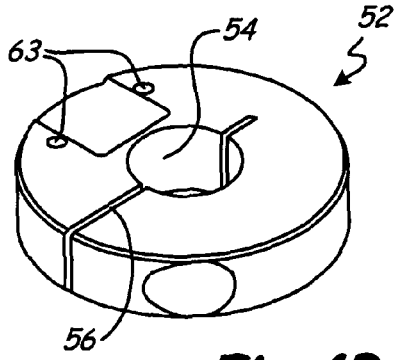
Figure 4C:
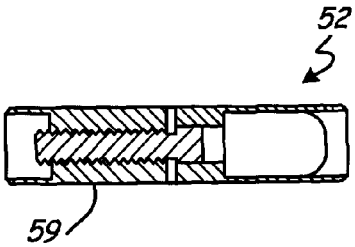
Figure 4D:
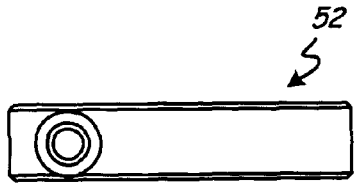
Figure 5:
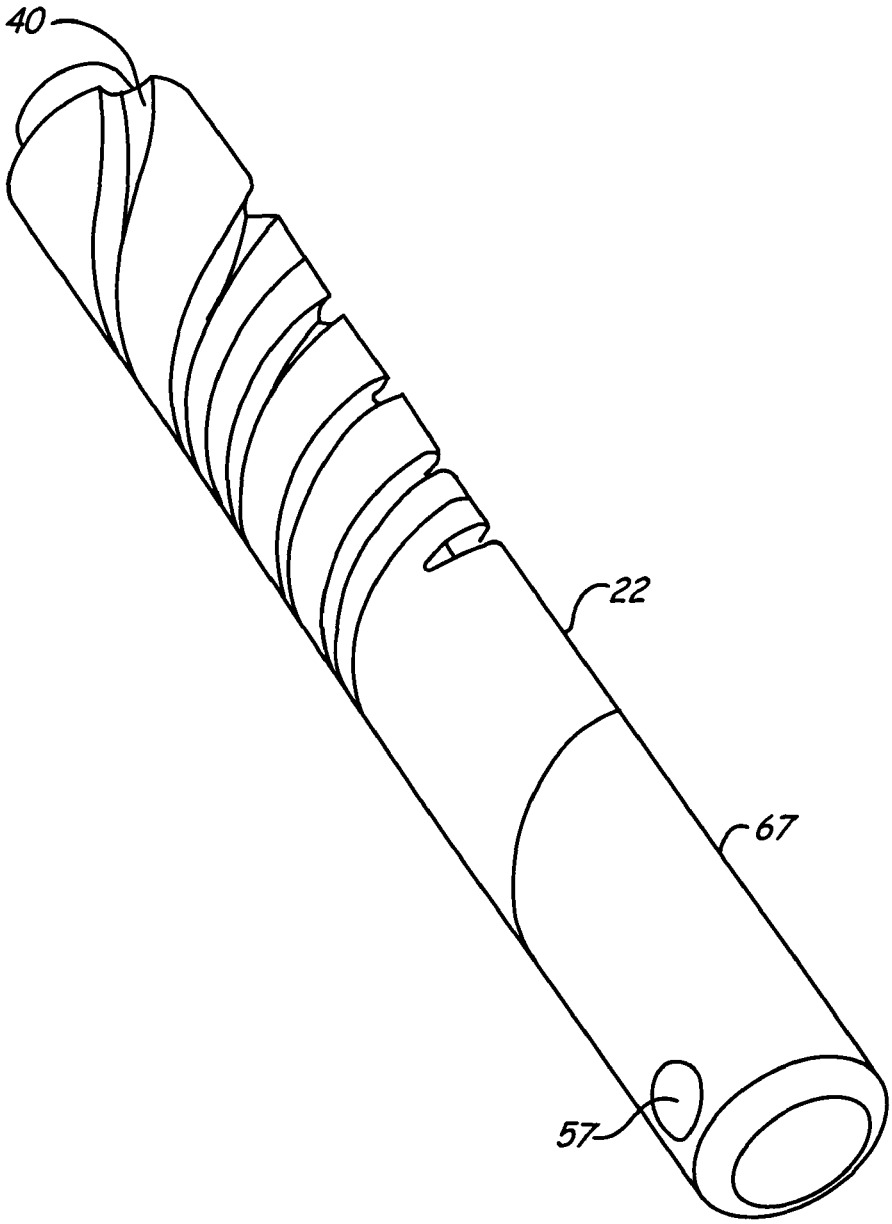
FIG. 5 is a perspective view of a rod having a spiral cam surface.

As best illustrated in the embodiment of FIG. 3, one particularly convenient, and thus advantageous form of a complementary member, is to use a ball 45 that projects beyond an inner surface of the bushing 44 so that a portion of the outer surface of the ball 45 engages the walls of the spiral groove 40 and another portion of the ball 45 engages surfaces of the bushing 44. In the embodiment illustrated, each of the ball(s) 45 is disposed in a bore 46 that extends from the inner surface of the bushing 44 to an outer surface. In this manner, each of the ball(s) 45 can be positioned in their corresponding bore 46 and groove 40 after the rod 22 or 23 has been inserted in a bore 47 formed by the inner surface of the bushing 44 and the rod 22 or 23 is rotated so as to align the bore(s) 46 with each respective groove 40. Once each of the ball(s) 45 fall into their corresponding groove 40, a plug 48 is inserted in the bore 46 so as to control the amount of projection of the ball 45 beyond the inner surface of the bushing 44 and into the groove 40. One convenient form of plug 48 is a set screw that threadably mates with threads provided in the bore 46. A compressible element or spacer 50 such as a nylon disk can be disposed between the ball 45 and the plug (e.g. set screw) 48. The compressible element 50 helps retain constant pressure of the ball 45 with the walls of the corresponding groove 40 which helps take up any play associated with balls 45 and/or between the difference in diameters between the rods 22 or 23 and the respective bore 47 in the corresponding bushing 44. This prevents rattling between these parts when the trainer 10 is in use, the rattling of which could be annoying and is found in existing trainers having couplers of different designs.

At this point it may be apparent why the words "essentially stationary" were used when describing the second cam surface. These words were chosen so as to allow for the fact that in some instances a cam surface may move such as the case where the ball 45 may rotate or partially rotate when the corresponding rod 22 or 23 moves axially. Nevertheless, with respect to axial movement of the each rod 22 or 23, the respective ball(s) 45 remain axially stationary.

In this embodiment, the degree of spiral of the groove(s) 40 (commonly referred to as "lead") on each of the rods 22 and 23, controls the extent of axial or linear movement of the corresponding rod 22 and 23 for partial rotation of the rods 22 and 23 caused by lever 29. The lead can be selected depending on the extent of movement desired of the rods 22 and 23 for movement of the lever 29 from a first position where the ends of the rods 22 and 23 are disposed away from the bicycle to a second position where the ends of the rods 22 and 23 secure the bicycle in position on the frame 14. As known in the art, adapters 50 and 51 can be disposed on each of the rods 22 and 23, respectively, and are of suitable shape to engage each respective portion of the bicycle (for example, but not limited to, the axle nuts 44). The adapters 50 and 51 can be mounted on each of the rods, 22 and 23, so as to allow the adapters 50 and 51 to move relative to the rods 22 and 23 in order to position the adapters 50 and 51 to properly engage the selected portions of the bicycle and also allow the rods 22 and 23 to rotate with respect to the adapters 50 and 51.

The first position of each rod 22 and 23 can be conveniently, and individually, adjusted relative to each respective end 16 and 17, by rotation of the rod 22 or 23. A stop can be provided to limit axial movement of each rod with respect to bushing 44, and in particular, inhibit the rod from being moved too far axially where the balls 45 fall out of the bushing 44. In the embodiment illustrated, the stop comprises a surface on each of the rods 22 and 23 that will contact another element of each respective end 16 and 17. By way of example, the stop comprises an o-ring 55 (FIGS. 2 and 6) fitted in a corresponding groove in each of the rods 22 and 23 that contacts bushing 63 when the rod 22 or 23 has been retracted a predetermined distance.

It should be noted, during such positioning, it may be necessary to release or decouple the lever 29 from the rod(s) 22 and 23 being positioned. Various types of fasteners can be provided to allow the lever 29 to be selectively coupled to the rods 22 and 23. In the exemplary design illustrated, each fastener 52 comprises a clamp that engages a surface (e.g. outer circumferential surface) of the rod 22 or 23 and can be rotated relative to the rod 22 or 23 when not or loosely engaging said surface. In this embodiment, a cross bore 57 is provided on the end of each rod 22 and 23 and is of size to allow a rod such as screwdriver to be inserted therein to aid in rotation of the rods for positioning. Alternatively or in addition a handle 59 as illustrated in the embodiment of FIG. 3 can be provided. As appreciated by those skilled in the art, various types of handles could also be used. Selective positioning of the each of the rods 22 or 23 allows the user to either ensure that the when the bicycle is secured in position, the wheel is in the middle of the roller of the resistance device, or alternatively, is in a selected position that is not in the center of the roller for any desired reason.

The clamp 52 is illustrated in FIGS. 4*a*, 4*b*, 4*c* and 4*d* and includes a bore 54 of size slightly larger than the circumferential surface of the rod 22 or 23, wherein a radial gap 56 can be selectively reduced when a bolt 58 (FIG. 1) is tightened upon threads of bore 59 that an inner surface of the bore 54 engages the rod 22 or 23. An end of the lever 29 is connected to the fastener 52 being formed integrally therewith to provide a single unitary body, or connected thereto using fasteners 61 (bolts engaging threads of apertures 63), welding, adhesives or the like. If desired, other types of fasteners can be used to secure the lever 29 to the rods 22 and 23 such as but not limited to set screws.

Figure 6:
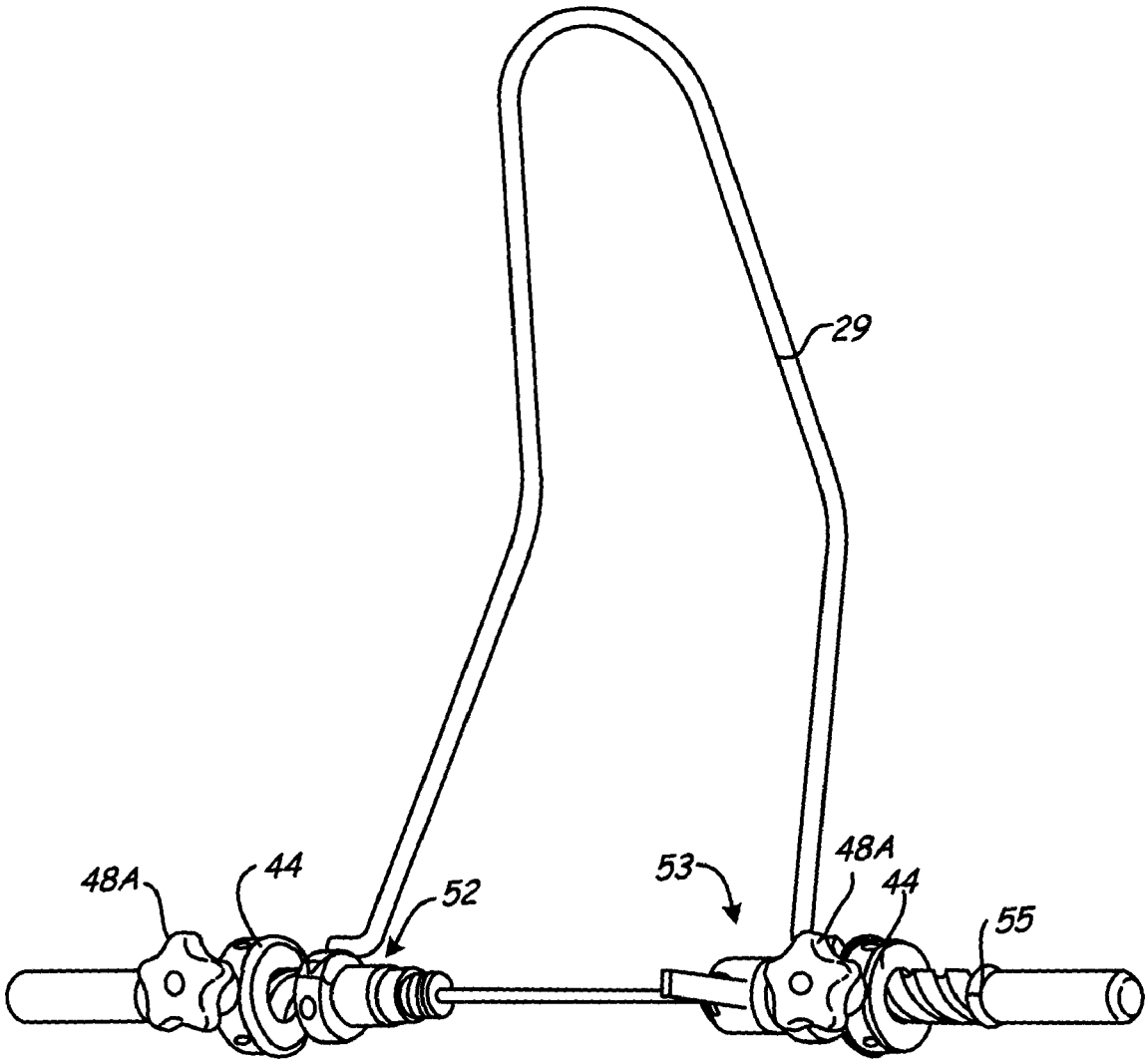
FIG. 6 is a perspective view of another embodiment of couplers with parts removed.
Figure 7:
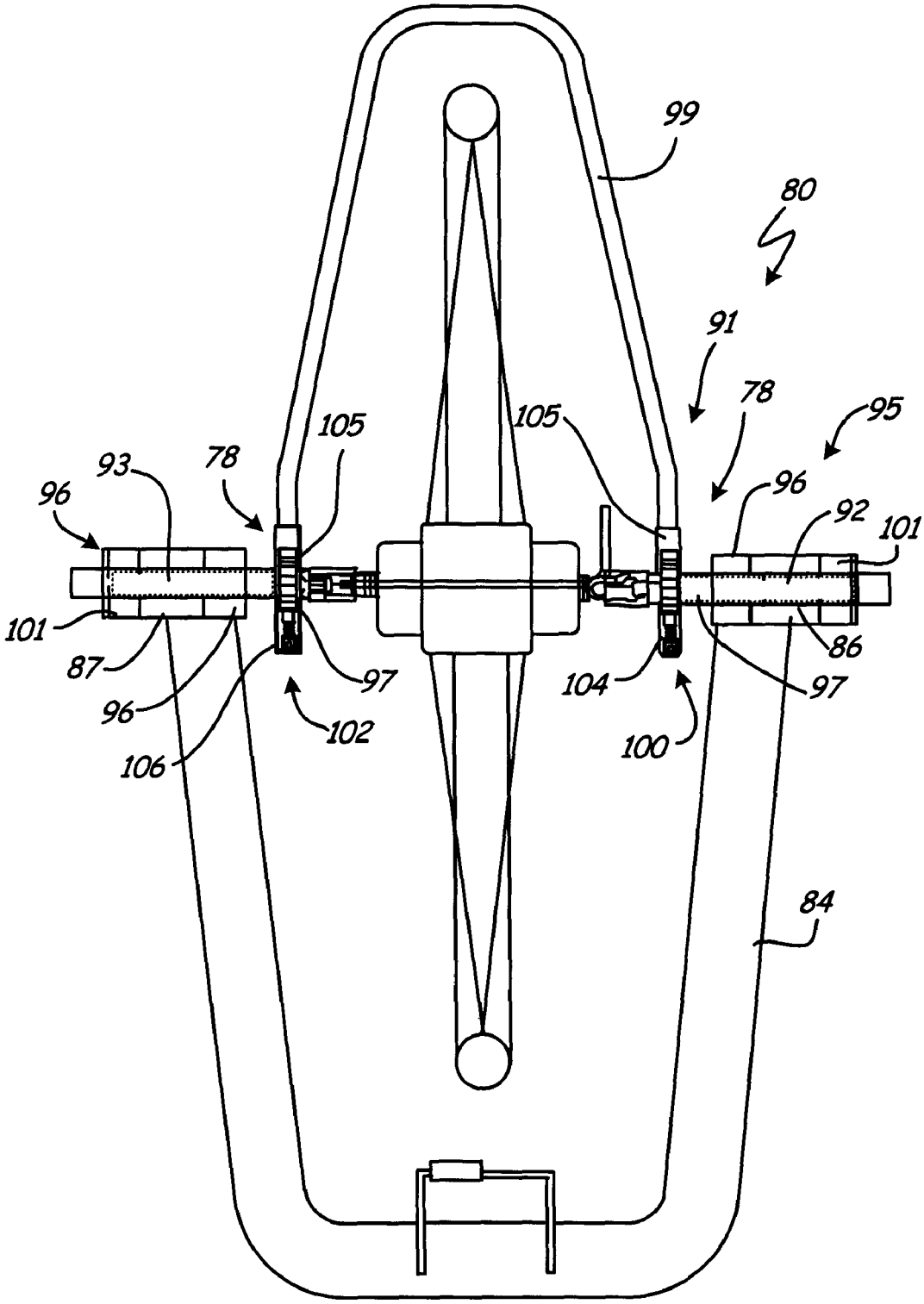
FIG. 7 is schematic view of another embodiment of a bicycle trainer frame.
Figure 8A:
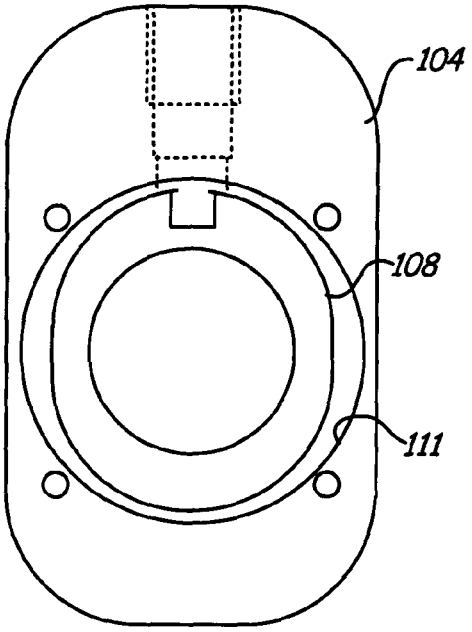
FIGS. 8A and 8B are views of an end portion of the lever of the bicycle trainer frame of FIG. 7.
Figure 8B:
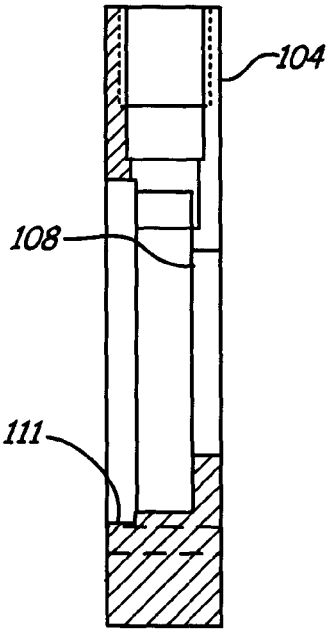
Figure 9:
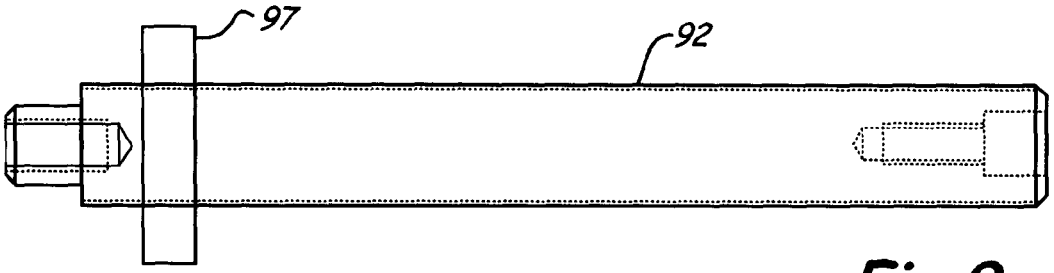
FIG. 9 is a elevational view of a rod of the bicycle trainer frame of FIG. 7.
Figure 10:
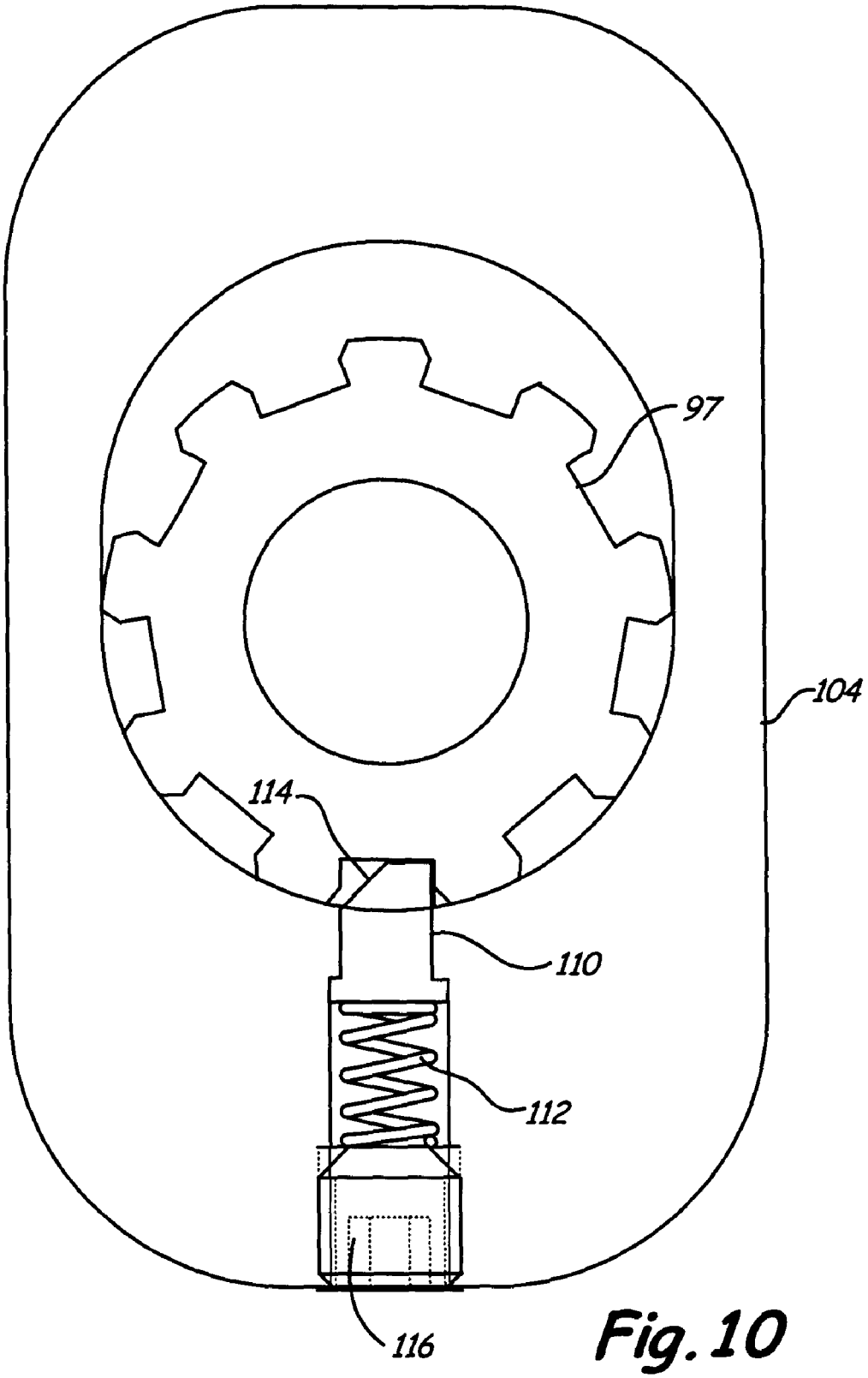
FIG. 10 is schematic view of a ratchet mechanism of the bicycle trainer frame of FIG. 7.

In a further embodiment, it may be desirable to increase and/or adjust the sliding resistance or friction on rod 22 and/or rod 23. In a first form, friction can be increased by amount of force exerted by the set screws on the balls 45. The location or accessibility of the set screws 48 would allow the user to adjust this force. In the embodiment of FIG. 6, increased friction is provided by adjusting the force or pressure of one of the balls 45 in its corresponding groove. In the embodiment illustrated, a handle 48A is attached to a setscrew (not shown) in order to adjust the pressure of the ball 45 upon the groove 40, and/or the pressure of the spacer (as in the previous embodiment) or setscrew on the ball 45. However since the position of each setscrew 48 in each respective bore 46 also ensures contact of the corresponding ball 45 with the associated groove 40, it may not be desirable to allow the user to access the set screws 48. In the embodiment of FIG. 3, this is accomplished by disposing the bore(s) 46 on the bushing 44 such that when the bushing 44 is mounted to the end 16 or 17, for example, by inserting it in a bore formed therein, the set screws 48 are inaccessible to the user by housing 65.

If desired, a separate device can be provided to selectively impede or inhibit movement of the rod 22 and/or rod 23. In one form, the device is a friction device that engages the corresponding rod 22 or 23. In the exemplary embodiment of FIG. 3, the friction device comprises an element 60 that bears against a surface of the rod 22 or 23. The element 60, for example, can be made of nylon or other suitable material, and disposed in a bore 62 of bushing 63, where a set screw 64 controls the amount of force applied by the element 60 to the surface of the rod 22 or 23. In the embodiment, illustrated this set screw 64 is adjustable by the user with a tool such as a wrench, or by a handle, for example threadably engaging an element of the end 16 or 17 such as housing 65 and/or bushing 63. In the embodiment of FIG. 3, the element 60 contacts the rod 22 between grooves 40. In the embodiment of FIGS. 1 and 3, each rod 22 has a smooth section 67 for element 60 to contact. As appreciated by those skilled in the art, the friction device that engages rod 22 or 23, or elements connected thereto, to inhibit rotation of the rod 22 or 23 can take many forms.

The bicycle is secured to the trainer 10 in the following manner. First, it may be necessary to adjust the position of each of the rods 22 and/or 23 in an initial position by disengaging the lever 29, if necessary, and rotating of each the rods 22 and 23 relative to each respective end 16 and 17 as discussed above. The lever 29 is then reattached to each of the rods 22 and 23. In the exemplary embodiment, the first position is when the rods 22 and 23 are spaced apart from each other to allow the bicycle wheel 11 to be placed upon the roller of the resistance device or removed therefrom. With the bicycle wheel 11 on the roller, the lever 29 is moved in the first motion or direction, herein upwardly, so as to cause the rods 22 and 23 to move toward each other. In view of the long length of the lever 29 and hence large moment arm, it is very easy to move, and thereby, create a large force that overcomes the friction inhibiting movement of the rods 22 and 23, and thereby, when the motion of lever 29 is stopped, the bicycle (herein the axle of the wheel) is clamped between the ends 16 and 17. In an advantageous embodiment, the length of the lever 29 is longer than the radius of the wheel of the bicycle so that motion of the lever 29 is unencumbered by components of the bicycle proximate the axle 27 and is spaced apart from the tire of the wheel 11. However in a further embodiment, the length of lever 29 is not too long that it is above a seat 70 of the bicycle.

The lever 29 is moved to the second position where the bicycle is secured to the frame 10. In the exemplary embodiment, this is when the lever 29 is placed proximate (typically below) the seat 70 of the bicycle, for example, proximate (due for example to contact with) a seat post 72 of the bicycle. Releasing the bicycle from the trainer, by causing the rods 22 and 23 to move away from each other, is caused by movement of the lever 29 back to the first position, herein away from the upright position proximate the bicycle seat to a lower position, closer to the ground. It should be noted in an alternative embodiment, the first and second positions of the lever 29 can be reversed so that the bicycle is secured when the lever 29 is in the lower position and removable from the frame 14 when the lever 29 is in the upright position proximate the seat of the bicycle.

In an advantageous embodiment, the lead of rods 22 and/or 23 is selected so that movement from the first position of lever 29 to the second position of lever 29 (operative range of motion) is less than one revolution. For ease of operation movement of the lever 29 it is particularly advantageous that the range is less than 180 degrees of pivotal motion about the axis of the rods 22 and/or 23. A very advantageous range of motion is between 45 degrees and 150 degrees, which allows the user to easily reach the lever 29 while holding the bicycle until the rods 22 and 23 move a sufficient distance to engage and hold the bicycle. The cam surfaces (e.g. the lead of the groove(s) 40) are configured so that each of the rods moves axially at least a ¼ of an inch for any of the operative ranges of motions of lever 29 described above. In a further embodiment, the cam surfaces are configured to so that each of the rods moves at least ⅜ of an inch for any of the operative ranges of motions of lever 29 described above. As the movement of the rods 22 or 23 increases for the operative ranges of motions of the lever 29, the ease of operation also increases. The lever 29 provides a sufficient moment arm to overcome friction and generate the clamping force between the ends.

Although illustrated wherein a single lever 29 is used to simultaneously operate both couplers 25 and 26, it should be noted in an alternative embodiment a separate lever can be used for each coupler 25 and 26 (i.e., the levers are not connected). In addition, it should also be noted that a single coupler 25 or 26 having one or more aspects described above can be provided with a single lever, which when operated provides sufficient rod movement that the other rod in the other coupler can be stationary or disposed in a fixed position during loading or removal of the bicycle from the frame 14. For example, the cam surfaces can be configured to provide sufficient rod displacement in the range of motions described above. For instance, the lead of groove(s) 40 of one of the rods 22 or 23 can be sufficiently long enough to operate using the range of motions described above.

In addition, although illustrated and/or described where a rigid connection is formed between the lever(s) and the rod(s) whereby motion of the lever(s) causes direct rotation of the rod(s), other mechanisms can be used to join the lever(s) to the rod(s). For instance, a ratchet mechanism can be implemented between the lever(s) and rod(s) so that repeated angular displacements of the lever(s) will rotate the rod(s). Although not illustrated such ratchet mechanisms are well known. Generally, a ratchet mechanism contains a gear (which can be rigidly connected to the rod(s)) with two step levers (i.e. "pawls") that are typically spring-loaded and connected to the lever(s). The mechanism uses one step lever at a time for each direction, whereby one of the step levers engage teeth of the gear to move rotate the gear in one direction, and will not engage the teeth in the opposite direction. A button, switch or lever on can be provided to switch the step levers so that it operates on the gear in an opposite manner.

An exemplary form of a ratchet mechanism 78 for a trainer 80 is illustrated in FIGS. 7-10. In this embodiment, a bicycle trainer frame 84 includes a support mechanism or assembly 91, comprising support couplers 95 and 96 that releasably supports the bicycle above a floor and to the frame 84. The couplers 95 and 96 are located in opposed support ends 86 and 87, respectively and include threaded rods 92 and 93 (having opposite left and right hand threads), respectively. Each of the threaded rods 92 and 93 threadably mate with a bushing 98 while a second, smooth bushing 101 can be provided if desired. Referring to FIGS. 8A and 8B, each rod 92 and 93 includes a gear 97 (FIG. 9) fixed thereto to rotate therewith.

Referring also to FIGS. 7, 8A, 8B and 9 and, a lever 99 includes end portion assemblies 100 and 102 having an end portion housing 104 (FIGS. 8A and 8B) and 106, respectively, that houses each of the gears 97 to form the ratchet mechanism 78. In the embodiment illustrated, each of the gears 97 are located in an oblong slot 108 that includes a projection 110, functioning similar to a pawl, projecting therein. A washer 105 is received by aperture 111 and functions as an end cap to retain the corresponding gear in each housing 104 and 106.

The housings 104 and 106 can move relative to the oblong slot 108 and thus can selectively engage the projection 110 with the gear 97. In particular, in the embodiment illustrated, when the lever 99 is biased upwardly, each of the projections 110 engage the gears 97 allowing the user to rotate the lever 99 so as to move the rods 92 and 93 toward or away from each other simultaneously. When the lever 99 is biased downwardly, the projections 110 do not engage the gears 97 so the lever 99 can be returned to a starting position (the first or second positions depending on whether the rods 92 and 93 are clamping or unclamping). The biasing and unbiasing of the lever 99 is repeated, if desired, until the rods 92 and 93 are sufficiently displaced.

In one embodiment as illustrated, the projections 110 can be spring biased herein by example with a compression spring 112 and wherein the projection 110 includes a chamfered surface 114. The chamfered surface 114 is the operable engaging surface of the projection 110 upon the gear 97 during tightening. In this manner, the projection 110 can retract and slide upon the chamfered surface 114 when a sufficient tightening (clamping force) has been obtained. A set screw 116 can be provided and can be adjusted to adjust the spring force and thus the desired clamping force.

Although illustrated wherein a single lever 99 is used to simultaneously operate both couplers 95 and 96, it should be noted in an alternative embodiment a separate lever can be used for each coupler 95 and 96 (i.e., the levers are not connected). In addition, it should also be noted that a single coupler 95 or 96 having one or more aspects described above can be provided with a single lever, which when operated provides sufficient rod movement that the other rod in the other coupler can be stationary or disposed in a fixed position during loading or removal of the bicycle from the frame 84.

Although the subject matter has been described in language directed to specific environments, structural features and/or methodological acts, it is to be understood that the subject matter defined in the appended claims is not limited to the environments, specific features or acts described above as has been held by the courts. Rather, the environments, specific features and acts described above are disclosed as example forms of implementing the claims.

What is claimed is:

1. A bicycle trainer frame adapted for use with a bicycle, the bicycle trainer frame comprising: a floor engaging stationary frame member having spaced apart ends; a coupler disposed in each end and having a movable element adapted to engage a portion of a bicycle to maintain the bicycle in an upright manner; and a lever connected to each coupler to operate each of the couplers so as to move the elements toward each other in a first directional movement of the lever and away from each other in a second directional movement of the lever.

2. The bicycle trainer frame of claim 1 wherein each element comprises a rod configured for at least linear movement.

3. The bicycle trainer frame of claim 2 wherein each rod is configured to at least partially rotate.

4. The bicycle trainer frame of claim 3 wherein each coupler comprises engaging cam elements configured to cause movement of each respective rod, wherein the lever is connected to one of the cam elements of each coupler.

5. The bicycle trainer frame of claim 3 wherein said lever is connected to each of said rods.

6. The bicycle trainer frame of claim 5 wherein the cam elements of each coupler comprise at least one spiral cam surface and a member engaging the said at least one spiral cam surface.

7. The bicycle trainer frame of claim 6 wherein each spiral cam surface comprise a groove.

8. The bicycle trainer frame of claim 7 wherein each member comprises a ball.

9. The bicycle trainer frame of claim 8 wherein the coupler includes a housing, and wherein the rod extends through a bore in the housing and the ball is held axially stationary in the housing for axial movements of the rod with respect to the housing.

10. The bicycle trainer frame of claim 9 and further comprising a mechanism configured to selectively adjust a force exerting the ball against the rod.

11. The bicycle trainer frame of claim 2 and further comprising a mechanism configured to selectively adjust a frictional force that inhibits axial movement of the rod.

12. The bicycle trainer frame of claim 2 and a ratchet mechanism operably coupled to end of the lever to rotate the rod.

13. A bicycle trainer frame adapted for use with a bicycle, the bicycle trainer frame comprising: a floor engaging stationary frame member having spaced apart ends; a lever; a coupler disposed in at least one of the ends, the coupler including a rod that is axially displaceable with at least partial rotation thereof wherein the end of the rod is adapted to engage a portion of a bicycle to maintain the bicycle in an upright manner, the rod including at least one spiral surface forming a first cam surface engaged by an axially stationary complementary member that includes a second cam surface engaging the first cam surface, the lever being connected to the rod to selectively rotate the rod, the at least one spiral surface being configured to displace the rod at least one-quarter of an inch for pivotal movement of the lever less than 180 degrees about an axis of the rod.

14. The bicycle trainer of claim 13 wherein the at least one spiral surface is configured to displace the rod at least one-quarter of an inch for pivotal movement of the lever in the range about 45 degrees to 150 degrees.

15. The bicycle trainer frame of claim 14 wherein the at least one spiral surface comprise a groove.

16. The bicycle trainer frame of claim 15 wherein each complementary member comprises a ball engaging the groove.

17. The bicycle trainer frame of claim 16 wherein the coupler includes a housing, and wherein the rod extends through a bore in the housing and the ball is held axially stationary in the housing for axial movements of the rod with respect to the housing.

18. The bicycle trainer frame of claim 16 and further comprising a mechanism configured to selectively adjust a force exerting the ball against the rod.

19. The bicycle trainer of claim 13 and further comprising a mechanism configured to selectively adjust a frictional force that inhibits axial movement of the rod.

20. A bicycle trainer frame adapted for use with a bicycle, the bicycle trainer frame comprising: a floor engaging stationary frame member having spaced apart ends; a coupler disposed in at least one of the ends, the coupler having cam elements with engaging cam surfaces to cause linear movement of a rod, wherein an end of the rod is adapted to engage a portion of a bicycle to maintain the bicycle in an upright manner, a lever connected to one of the cam elements; wherein the cam surfaces are configured to cause at least one-quarter of an inch of linear movement for rotation of lever less than one revolution such that the rod moves from a first position to a second position, the first position being spaced apart from a component of the bicycle to allow removal of the bicycle from the frame, and the second position being sufficient to secure the bicycle to the frame.

21. A bicycle trainer frame adapted for use with a bicycle, the bicycle trainer frame comprising: a floor engaging stationary frame member having spaced apart ends; a bicycle engageable coupler disposed in at least one of the ends, the coupler having cam elements with engaging cam surfaces to cause linear movement of a rod; a lever connected to one of the cam elements wherein the lever is longer than a radius of a bicycle wheel mounted to the frame; wherein the cam surfaces are configured to cause linear movement for rotation of lever less than one revolution such that the rod moves from a first position to a second position, the first position being spaced apart from a component of the bicycle to allow removal of the bicycle from the frame, and the second position being sufficient to secure the bicycle to the frame.

* * * * *